US006863417B2

(12) United States Patent
Hill

(10) Patent No.: US 6,863,417 B2
(45) Date of Patent: Mar. 8, 2005

(54) OPERATING THEATER LAMP

(75) Inventor: Wolfram Hill, Freiburg (DE)

(73) Assignee: Berchtold Holding GmbH, Tuttlingen (DE)

( * ) Notice: Subject to any disclaimer, the term of this patent is extended or adjusted under 35 U.S.C. 154(b) by 0 days.

(21) Appl. No.: 10/125,775

(22) Filed: Apr. 17, 2002

(65) Prior Publication Data

US 2002/0191389 A1 Dec. 19, 2002

(30) Foreign Application Priority Data

Apr. 19, 2001 (DE) ..... 101 19 215

(51) Int. Cl.[7] ..... F21S 13/02
(52) U.S. Cl. ..... 362/233; 362/285; 362/804
(58) Field of Search ..... 362/233, 265, 362/404, 804, 285; 359/152, 154, 142, 159

(56) References Cited

U.S. PATENT DOCUMENTS

| | | | | |
|---|---|---|---|---|
| 3,287,552 A | * | 11/1966 | Drandell | 362/233 |
| 4,757,426 A | * | 7/1988 | Scheller et al. | 362/20 |
| 5,161,088 A | * | 11/1992 | Burgher et al. | 361/836 |
| 5,526,245 A | | 6/1996 | Davis et al. | |
| 6,160,582 A | * | 12/2000 | Hill | 348/370 |
| 6,424,442 B1 | * | 7/2002 | Gfeller et al. | 398/135 |
| 6,471,363 B1 | * | 10/2002 | Howell et al. | 362/11 |

FOREIGN PATENT DOCUMENTS

| | | |
|---|---|---|
| DE | G 9409880.8 | 11/1994 |
| DE | 19803494 | 12/2000 |
| DE | 19935003 | 2/2001 |
| TW | 161725 | 6/1991 |

OTHER PUBLICATIONS

May, et al., "Funkfernsteuerbare Schweinwerfer im mobilen Einsatz [Mobile operation of radio remote–controlled spotlights]," in: BTR, pp. 18–21, (May 1994).

* cited by examiner

*Primary Examiner*—Alan Cariaso
*Assistant Examiner*—Mark Tsidulko
(74) *Attorney, Agent, or Firm*—Townsend and Townsend and Crew, LLP

(57) ABSTRACT

This invention provides an optically controlled dimmer (optically controlled light adjustment device), more particularly, an optically controlled dimmer having a mechanism capable of detecting light reflected from an object in a short distance and to cause a driving circuit to perform ON-OFF action and to adjust the intensity of light in several stages. The mechanism includes an ultra red ray transmitter to perform the control. A transmitter and a receiver are disposed in parallel in a recess of a casing having a panel. The panel has one hole for transmitting control signal light, and another hole for receiving reflected signal light. The dimmer can be activated by blocking the signal light transmitted from the dimmer by hand, to produce a reflected signal light to be received by the receiver. The received reflected signal light is reformed by a stage control circuit and a switching circuit to perform ON-OFF actions. As a result, the intensity of light is controlled in stages.

16 Claims, 1 Drawing Sheet

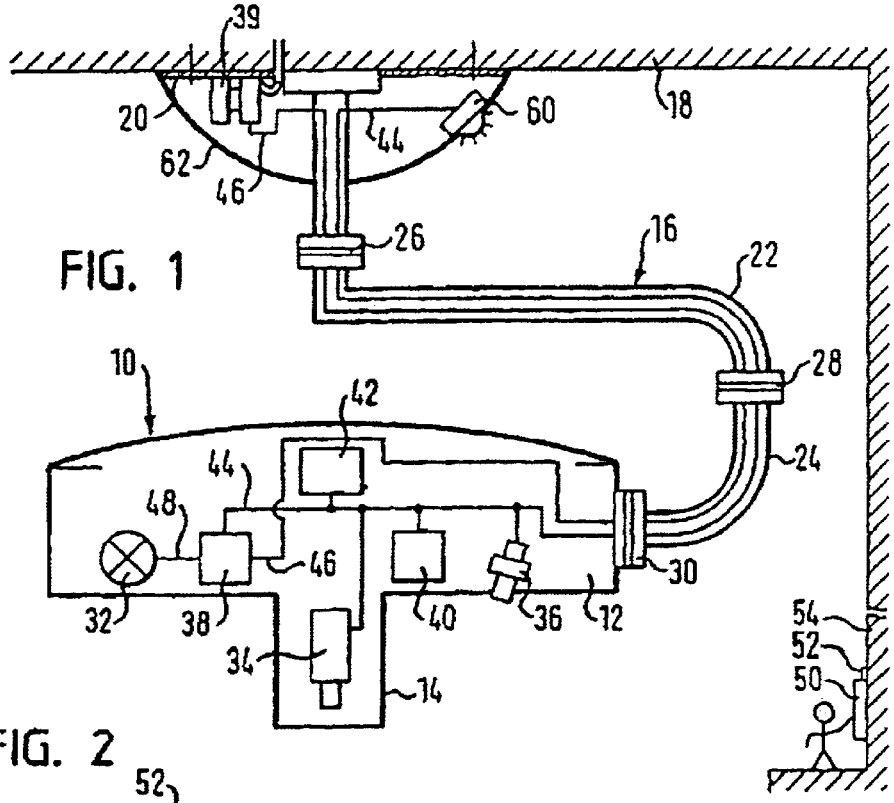
FIG. 1
FIG. 2
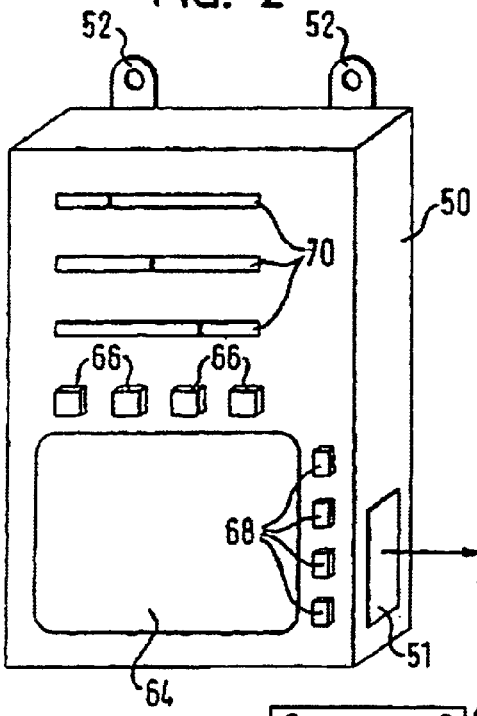
FIG. 3
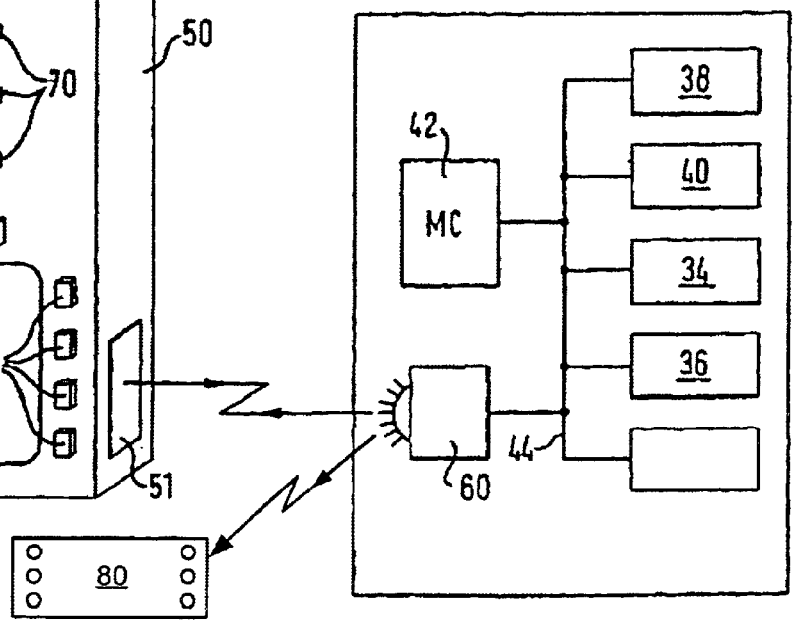

OPERATING THEATER LAMP

The present invention relates to an operating theater lamp having a lamp body with a suspension, at least one functional assembly arranged in the lamp body or in the suspension, a control unit arranged in the region of the lamp body to control the functional assembly and a console in the form of a wall box which is provided with fastening means for a wall fastening.

Such operating theater lamps are known from the prior art. The functional assembly can be a dimmer for regulating the brightness of the lamp, a focus adjustment, a camera installed in the lamp body or the like. In this connection, the wall box serves as a console for the control unit to select the functional assemblies of the operating theater lamp. Since the console is designed as a wall box installed at a wall, the functional assemblies of the operating theater lamp can be manipulated from a region which is not disposed directly above the operating position. At the same time, the wall box is located outside the highly sterile region, which is advantageous with regard to cleaning.

The circumstance is a problem with operating theater lamps of the kind initially named that the electrical linking of the wall box to the control unit arranged in the region of the lamp body often results in increased difficulties, in particular when operating theater lamps are retrofitted in an operating theater, since the required cabling can often only be fitted retrospectively with increased difficulties.

It is the object of the present invention to provide an operating theater lamp of the kind initially named which is simple to install.

This object is satisfied by the features of claim 1 and in particular in that a wireless communication connection, and in particular a bidirectional communication connection is provided between the control unit and the wall box.

In accordance with the invention, electrical connection cables between the wall box and the operating theater lamp can be omitted so that a simple installation is possible, in particular in a retrofitting of operating theater lamps. At the same time, however, no conventional hand-held remote control is used which might not be found fast enough under certain circumstances in case of danger in an operating theater. The wall box provided in accordance with the invention is fixedly installed to a wall so that the staff can make an adjustment to the operating theater lamp without any further consideration and without time loss.

Advantageous embodiments of the invention are described in the description, the drawing and the dependent claims.

In accordance with a first advantageous embodiment, a plurality of functional assemblies can be provided, with the functional assemblies being connected to one another and to the control unit via a single line, in particular a wire lead signal line, designed as a data bus.

In this embodiment, the installation effort in the assembly of the operating theater lamp is substantially reduced, with at the same time the number of the cables to be accommodated in the lamp body or in the hanging being minimized. In this embodiment, only a single signal line is required which connects the individual functional assemblies to one another and to the control unit. With such a data bus, which can be designed as a LAN (local area network), all functional assemblies can be addressed by the control unit without every single functional assembly having to be connected to the control unit via a separate signal line.

In this connection, it is particularly advantageous if the wall box and the control unit are also connected to one another via this data bus, since in this way only one single data bus is required for all functions of the operating theater lamp.

In accordance with a further advantageous embodiment, a functional assembly can be designed as a receiver module connected to the data bus or as a transceiver module which produces a wireless communication connection to the wall box. This embodiment has the advantage that a further separate module is provided for making the wireless communication connection which can be installed at any position in the lamp body or in or at the suspension, with the connection of this module to the data bus line also being sufficient in this case to manipulate the operating theater lamp from the wall box.

In accordance with a further advantageous embodiment, a receiver module or transceiver module is provided in the region of the suspension which produces a wireless communication connection to the wall box. In this embodiment, the advantage results that the receiver module, which can receive infrared radiation, radio waves or ultrasonic waves, can be installed at a fixed location in the region of the suspension such that the relative position between the receiver module and a transmitter in the region of the wall box remains unchanged. In this way, the transmitter in the wall box can be adjusted to the fixed location receiver and there is no displacement in the event of a positional change of the lamp body.

In accordance with a further advantageous embodiment, a further console for a camera arranged in the lamp body can be provided in addition to the wall box, with a wireless communication connection being provided between the further console and the control unit. In this embodiment, the advantage results that the camera installed in the lamp body can be manipulated from a different position than the operating theater lamp itself, with the advantage nevertheless being maintained that no additional cabling is required between the further console and the operating theater lamp.

In accordance with a further embodiment of the invention, audio and/or video signals can be transmitted via the wireless communication connection, whereby the number of signal lines can be further reduced. For this purpose, converters can be provided at the lamp and in the wall box with whose help a conversion is possible between audio and/or video signals and such signals which can be communicated via the data bus.

In accordance with a further advantageous embodiment, the wall box is provided with its own power supply, in particular a power supply independent of the mains. It is in this way not necessary for a separate power supply to be made available for the wall box. The wall box can rather be mounted at any desired position within the operating theater, with only one power supply having to be made available. If the wall box has a power supply independent of the mains, for example a battery or a rechargeable battery, the supply of a mains dependent power can be omitted.

In accordance with a further advantageous embodiment of the invention, the wall box has a flat screen. In this way, operating states of the operating theater lamp can be displayed in a particularly comfortable manner. In this connection, it is advantageous if function keys, preferably programmable function keys, are provided next to the flat screen. Alternatively, or additionally, the flat screen can be sensitive to touch, that is be made as a so-called touch screen. In this way, not only a comfortable operation of the operating theater lamp is possible, rather the cleaning of the wall box is simultaneously facilitated.

The present invention will be described in the following by way of example with reference to advantageous embodiments and to the enclosed drawings. There are shown:

FIG. 1 a schematic view of an operating theater lamp suspended at a ceiling;

FIG. 2 a perspective view of a wall box; and

FIG. 3 a schematic circuit diagram of the electronic functional assemblies arranged in the lamp body.

FIG. 1 shows an operating theater lamp 10 which has a lamp body 12 with a handle 14, with the lamp body 12 being installed at the ceiling 18 of an operating theater via a suspension 16. The suspension 16 includes an installation plate 20 for ceiling mounting and a plurality of pivot arms 22, 24 (only two pivot arms are shown in the embodiment shown). The pivot arms 22, 24 are each connected to one another, to the lamp body 12 and to the installation plate 20 via pivot bearings 26, 28, 30. The pivot bearings 26, 28, 30 can each be rotated through 360°. In this connection, the electrical lines disposed inside the pivot arms are guided in a conventional manner via sliding contacts to allow a multiple 360° pivot.

A plurality of lighting means 32 are provided in a conventional manner in the lamp body 12. Furthermore, different functional assemblies are disposed in the lamp body 12, namely a video camera 34 arranged in the handle 14, an electrically adjustable light pen 36, a dimmer 38 for the lighting means 32 and an electrically operable light field adjustment 40. A central control unit 42 serves for selecting these functional assemblies. This control unit is connected to the individual functional assemblies via a single signal line 44. This signal line 44 is designed as a bidirectional data bus (LAN) and connects the individual functional assemblies to one another and to the control unit 42. A further line 46 serves for the power supply of the lighting means 32. The line 46 connects a transformer 39 to the dimmer 38 which produces available a corresponding output signal in dependence on the control signals supplied to it, said output signal being supplied to the lighting means 32 via a further line 48.

A console in the form of a wall box 50 is provided for the operating of the control unit 42. The wall box 50 is provided with attachment means 52 for installation at a wall 54 of the operating theater. The wall box 50 communicates with the control unit 42 in a wireless manner in part and in a wire connected manner in part, this means that for the path disposed between the operating theater lamp 10 and the wall box 50, a wireless communication connection is selected, whereas the communication within the lamp 10 takes place in a wire connected manner. For this purpose, a transceiver module 60 is provided in the region of the suspension 16 and is arranged in the embodiment shown within a cover 62 which covers the installation plate 20 and the parts fastened to it (transformer 39 and electronic circuits (not shown)). The communication between the wall box 50 and the transceiver module 60 takes place in a wireless manner, preferably via infrared. The further communication between the transceiver module 60 and the control unit 42 takes place in a wire connected manner via the signal line 44 which is guided through the pivot arms 22, 24 of the suspension. The power supply of the lighting means 32 takes place via the further electrical line 46 which is likewise guided through the pivot arms of the suspension 16 and which connects the lighting means 32 to the associated transformer 39 via the dimmer 38.

FIG. 2 shows a perspective view of the wall box 50 which is provided at its upper side with two attachment means 52 for a wall installation. In the embodiment shown, two tabs are molded to the wall box 50 formed as a rectangular container and are each provided with a bore. However, it is understood that other attachment means can be considered, for example bores in the base of the wall box or a separate installation plate or the like.

A flat screen 64 is provided at the front side of the wall box 50 and can be made as a touch screen. Diverse operating elements 66, 68 are disposed next to the flat screen 64 and can be made in a fixedly wired manner or as soft keys. Furthermore, setting regulators 70 are provided to set the brightness or the light field of the lamp, for example.

A region 51 permeable to radiation, in particular to infrared ration, is provided at the wall box 50. A transceiver module is provided behind this region 51 at the inner side of the wall box and communicates in a wireless manner, in particular via infrared radiation, with the transceiver module 60 which is provided in the region of the suspension 16. Furthermore, the wall box has its own power supply. In this connection, it can be an integrated power pack or a rechargeable battery or a battery.

FIG. 3 shows a schematic circuit diagram of the functional assemblies 34–40 which communicate with the control unit 42 via the data bus 44. As can be seen, the transceiver module 60 is also connected to the data bus 44 such that all control commands, which are input via the operating elements 64, 66, 68 and 70 of the wall box 50, are first passed on via the wireless communications path between the wall box 50 and the transceiver module 60 and from there via the bidirectional signal line 44 to the control unit 42. The control unit 42 subsequently guides the corresponding control commands on to the respective functional assemblies, for example, to vary the brightness of the lighting means, to influence the focus or the zoom of the video camera 34 to cause a light field adjustment or to manipulate the light pen 36.

As is indicated in FIG. 3, further functional assemblies can still be connected to the data bus 44, for example to transmit speech signals, to signal the failure of lighting means, to switch to a moderate lighting (endoscopic light) or the like.

Reference numeral list

| | |
|---|---|
| 10 | operating theater lamp |
| 12 | lamp body |
| 14 | handle |
| 16 | suspension |
| 18 | ceiling |
| 20 | installation plate |
| 22, 24 | pivot arms |
| 26, 28, 30 | pivot bearings |
| 32 | lighting means |
| 34 | video camera |
| 36 | light pen |
| 38 | dimmer |
| 39 | transformer |
| 40 | light field adjustment |
| 42 | control unit |
| 44 | signal line (data bus) |
| 46, 48 | line |
| 50 | wall box |
| 51 | radiation permeable region |
| 52 | attachment means |
| 54 | wall |
| 60 | transceiver module |
| 62 | cover |
| 64 | flat screen |
| 66, 68 | function keys |
| 70 | setting regulator |

What is claimed is:

1. An operating theater lamp, including:

a lamp body with a suspension;

at least one functional assembly arranged in the lamp body or in the suspension;

a control unit arranged in the lamp body for controlling the functional assembly; and a stationary wireless console configured to operate with the control unit of the operating theater lamp, the console in the form of a wall box that is provided with attachment means for fixed attachment to a wall, wherein a wireless communication connection is provided between the control unit and the wall box.

2. An operating theater lamp in accordance with claim 1, wherein a plurality of functional assemblies are provided; and the functional assemblies are connected to one another and to the control unit via a single signal line designed as a data bus.

3. An operating theater lamp in accordance with claim 2, wherein the wall box and the control unit are connected to one another in a wireless manner via the data bus which is converted into wireless signals in a transceiver module for wireless communication.

4. An operating theater lamp in accordance with claim 2, wherein a functional assembly is made as at least one of a receiver module connected to the data bus and a transceiver module that produces a wireless communication connection to the wall box.

5. An operating theater lamp in accordance with claim 1, wherein a receiver module or a transceiver module is provided in the region of the suspension and produces a wireless communication connection to the wall box.

6. An operating theater lamp in accordance with claim 1, wherein in addition to the wall box, a further console is provided for a camera, with a wireless communication connection being provided between the further console and the control unit.

7. An operating theater lamp in accordance with claim 1, wherein at least one of an audio and video signals can be transmitted via the wireless communication connection.

8. An operating theater lamp in accordance with claim 1, wherein the wall box is provided with its own power supply.

9. An operating theater lamp in accordance with claim 1, wherein the wall box has a flat screen.

10. An operating theater lamp in accordance with claim 9, wherein function keys are provided next to the flat screen.

11. An operating theater lamp in accordance with claim 9, wherein the flat screen is made as a touch screen.

12. An operating theater lamp in accordance with claim 1, wherein no operating elements for individual functional assemblies are provided at the suspension.

13. The operating theater lamp in accordance with claim 1, wherein the wireless communication link comprises a bidirectional communication connection.

14. The operating theater lamp in accordance with claim 2, wherein the single signal line comprises a wire lead signal line.

15. The operating theater lamp in accordance with claim 8, wherein the power supply is independent of the mains.

16. The operating theater lamp in accordance with claim 10, wherein the function keys comprise programmable function keys.

* * * * *